US006415926B1

(12) United States Patent
Long

(10) Patent No.: US 6,415,926 B1
(45) Date of Patent: Jul. 9, 2002

(54) SAND SCULPTURE TOOL KIT

(76) Inventor: Matthew Long, 15 Colonial Ct., S.I., NY (US) 10310

( * ) Notice: Subject to any disclaimer, the term of this patent is extended or adjusted under 35 U.S.C. 154(b) by 0 days.

(21) Appl. No.: 09/572,412

(22) Filed: May 18, 2000

(51) Int. Cl.[7] ..... B65D 69/00
(52) U.S. Cl. ..... 206/575; 206/373; 446/70
(58) Field of Search ..... 206/223, 575, 206/349, 372, 373; 30/169; 446/70, 73, 75

(56) References Cited

U.S. PATENT DOCUMENTS

| | | | | | |
|---|---|---|---|---|---|
| 1,488,326 | A | * | 3/1924 | Dubee | 30/169 |
| 3,685,942 | A | | 8/1972 | Shaffer | |
| D272,552 | S | | 2/1984 | Clanton | |
| 4,455,752 | A | | 6/1984 | Koulouras | |
| 4,466,188 | A | * | 8/1984 | Svendsgaard | 30/169 |
| 4,828,114 | A | | 5/1989 | Bardeen | |
| 4,969,268 | A | * | 11/1990 | Kelly, III | 30/169 |
| 5,056,225 | A | * | 10/1991 | Jubran et al. | 30/169 |
| 5,072,514 | A | * | 12/1991 | Jubran et al. | 30/169 |
| 5,077,897 | A | * | 1/1992 | Jubran et al. | 30/169 |
| 5,108,336 | A | | 4/1992 | Rosier | |
| 5,379,542 | A | * | 1/1995 | Guzman | 30/169 |
| 5,429,541 | A | * | 7/1995 | Landon | 446/70 |
| 5,585,123 | A | | 12/1996 | Busby | |
| 5,730,293 | A | | 3/1998 | Kelly et al. | |
| 5,924,204 | A | * | 7/1999 | Lane | 30/169 |
| 5,941,712 | A | * | 8/1999 | Smith | 446/70 |

* cited by examiner

*Primary Examiner*—Luan K. Bui
(74) *Attorney, Agent, or Firm*—Mary A. Whiting, Esq.

(57) ABSTRACT

The device consists of different sized and shaped tools for creating free form sand sculptures, contained in a netted bag. The tools range from larger sized tools with grooved handles for heavier shoveling and scraping, to finer shaped tools with smooth handles for detailing work. Children can use the tools to make simple sand sculptures, while adults can also use the tools to create finely crafted sculptures for recreational enjoyment, contests or professional use. The tools and bag are brightly colored, and made of plastic. They are visible if buried in the sand, and float is swept away by the tide. They are durable, easily cleaned, and safe for use by children and use at the beach. The tools can also be used to create snow sculptures.

3 Claims, 7 Drawing Sheets

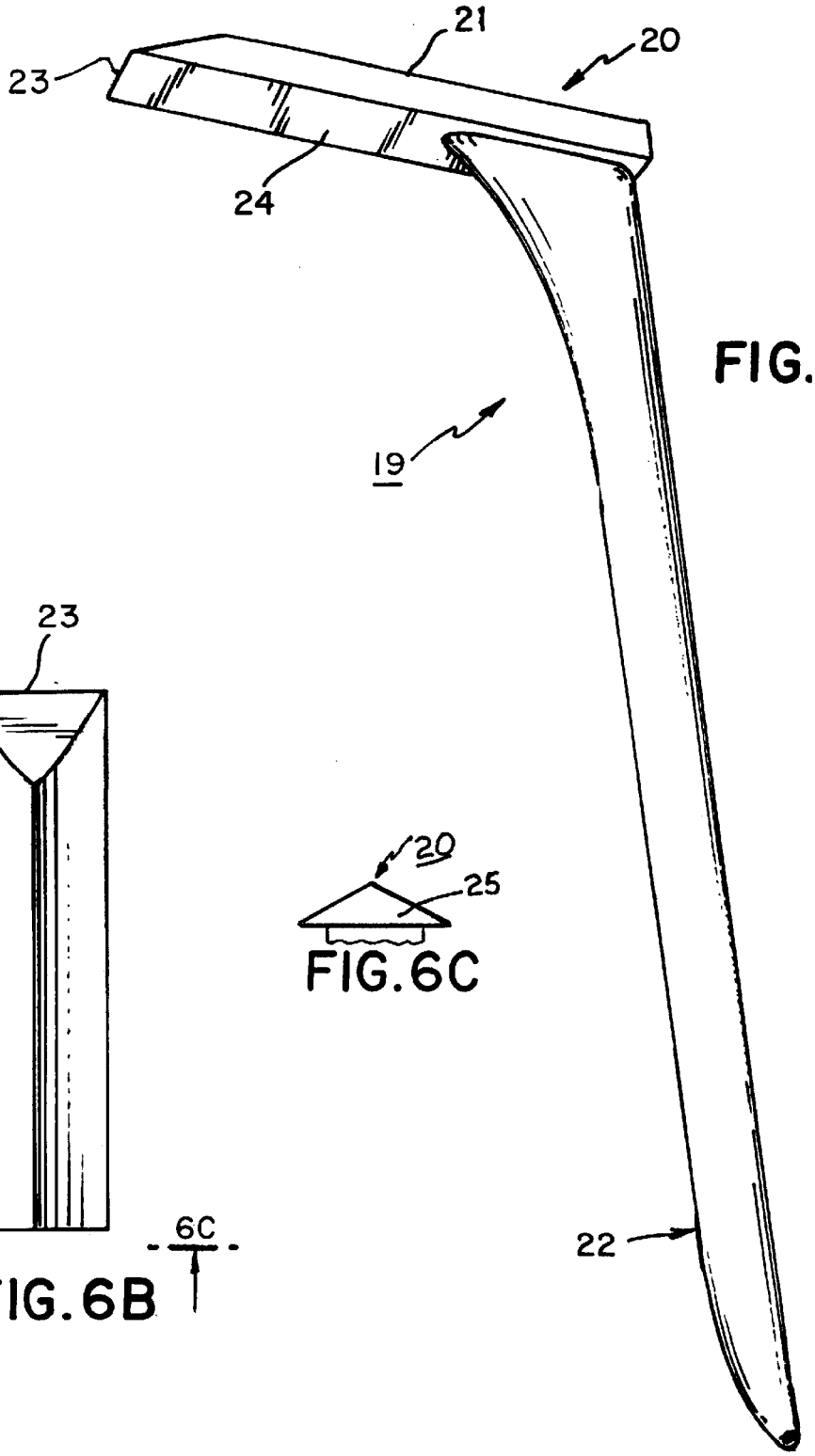
FIG.6A
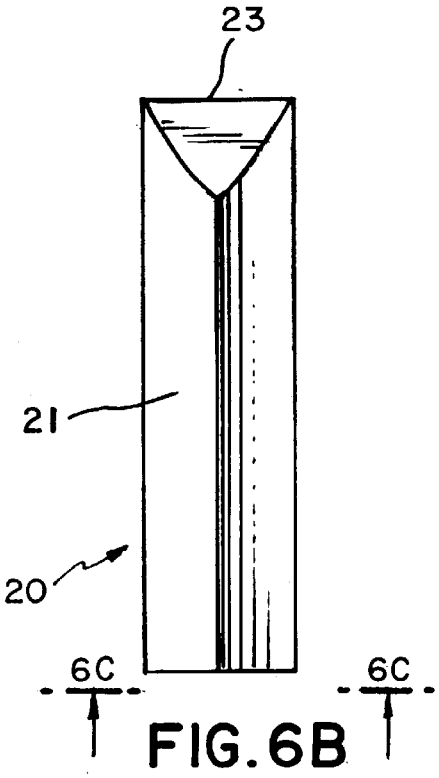
FIG.6B
FIG.6C

SAND SCULPTURE TOOL KIT

BACKGROUND—FIELD OF INVENTION

1. Field of Invention

The present invention relates to a collection of hand held tools for creating sand sculptures, to be used by both children and adults.

2. Background—Description of the Prior Art

Prior art devices disclose various tools for producing sculptured works of sand, ice or snow, or for carving pumpkins, whereby the devices are hand held and have either molding, sculpting or carving capabilities.

There are several patents which disclose various molding, sculpting or carving devices:

| Inventor | Pat. No. | Date |
|---|---|---|
| Kelly et. al | U.S. 5,730,293 | Mar. 24, 1998 |
| Busby, Phillip J. | U.S. 5,585,123 | Dec. 17, 1996 |
| Rosier, Phillip | U.S. 5,108,336 | Apr. 28, 1992 |
| Bardeen, John P. | U.S. 4,828,114 | May 9, 1989 |
| Koulouras, Katherine | U.S. 4,455,752 | Jun. 26, 1984 |
| Clanton, W. Porter | Des. 272,552 | Feb. 7, 1984 |
| Shaffer, Jasper Dean | U.S. 3,685,942 | Aug. 22, 1972 |

Kelly, et. al., U.S. Pat. No. : 5,730,293 dated Mar. 24, 1998, is a kit for creating sculpted shapes from molds, whereby sand is submerged in water and contained in a receptacle. The present invention differs from Kelley, et. al., since it is for creating free form sculptures on an above ground surface, preferably a beach, where the sand is damp and not submerged in water.

Busby, U.S. Pat. No. : 5,585,123 dated Dec. 17, 1996, is a sculpting tool for shaping sand, snow, or clay. While holding the tool in its center, the user creates pre-determined serration patterns using the sculpting head or oppositely facing cutting elements for cutting or scooping. The present invention differs since its user creates free form shapes while holding the tools by the handle.

Rosier, U.S. Pat. No. : 5,108,336 dated Apr. 28, 1992, is a shovel for making a mold in the sand. The present invention differs since it creates free form sculptures and does not rely on predetermined molds to create shapes.

Bardeen, U.S. Pat. No. : 4,828,114 dated May 9, 1989, is a pumpkin carving kit including different types of cutting tools, drill and saw elements, and at least one pattern sheet having a decorative design for creating designs on pumpkins. Sand is a viscous medium, while pumpkins have a fleshy or hard composition. Therefore, the present invention differs since it is for carving or slicing free form shapes, rather than sawing or cutting from pre-determined design pattern sheets Koulouras, U.S. Pat. No. : 4,455,752 dated Jun. 26, 1984, is a sand toy of a general planar body having serrations and finger engaging holes, to create serrations in sand. The present invention differs since it is a kit of different shaped tools that create free form sand sculptures, rather than serration in the sand surface.

Clanton, U.S. Pat. No. : Des. 272,552 dated Feb. 7, 1984, references a design of a children's toy shovel. The present device is a useful invention for children as well as adults that contains differently shaped tools with various functions for creating finely sculpted sand sculptures.

Shaffer, U.S. Pat. No. : 3,685,942 dated Aug. 22, 1972, references a device for producing compacted blocks of snow, which can then be shaped in snow sculptures. The present invention differs since it creates free form sculptures of sand and does not rely on predetermined molds to create shapes.

OBJECTS AND ADVANTAGES

Accordingly, besides the distinctions from the prior art stated above, several objects and advantages of the present invention are:

To provide for a device wherein the tools are contained in one easily transportable container;

To provide for a device wherein the user can use various shaped tools to create free form sculptures out of sand, each tool being distinctly shaped and sized to create desired details in the sculptures;

To provide for a device wherein the tools and the container are easily cleaned;

To provide for a device wherein the device is brightly colored, so as to be distinctly seen in order to diminish the chance of being lost in the sand;

To provide for a device preferably made of molded plastic, so as to be waterproof and float if tide water washes up to the user's work area; and To provide for a device preferably made of plastic, so as not to be easily broken or fractured and therefore safe for children's use and at the beach.

BRIEF DESCRIPTION OF THE DRAWINGS

FIG. 6*a* is a perspective view of a tool with rectangular shaped head, which comes in a plurality of sizes, large, medium and small, showing its flat rectangular shaped underside portion for scraping, edge for detailing, smooth handle portion, and its pyramidal shaped top portion for smoothing.

FIG. 6*b* is a perspective top view of the tool with rectangular shaped head, showing in detail, its pyramidal shaped top portion for smoothing.

FIG. 6*c* is a cross-sectional view showing in detail, its flat triangular shaped back portion for smoothing.

Figure 1:
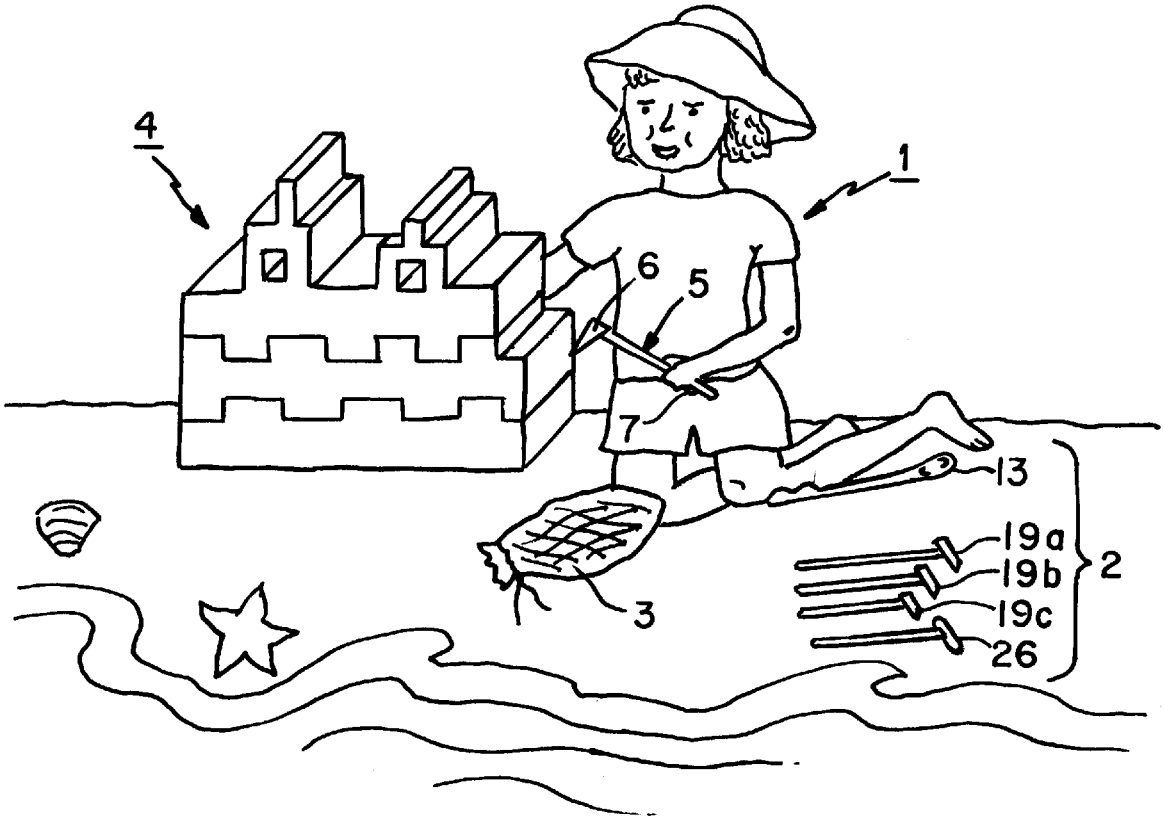
FIG. 1 is a perspective view of the present invention, showing the tools being used by a child with the tools taken out of the net carrying bag.

| Reference Numbers in the Drawings | |
|---|---|
| 1. | User |
| 2. | Device |
| 3. | Net carrying bag |
| 4. | Sculpture |
| 5. | Tool with wedge shaped head |
| 6. | Wedge shaped head portion |
| 7. | Grooved handle portion |
| 8. | Flat rectangular shaped back portion |
| 9. | Pair of flat triangular shaped side portions |
| 10. | Edge |
| 11. | Flat rectangular shaped top portion |
| 12. | Flat rectangular shaped underside portion |
| 13. | Tool with elliptical shaped head |
| 14. | Elliptical shaped head portion |
| 15. | Grooved handle portion |
| 16. | Concave shaped front portion |
| 17. | Convex shaped back portion |
| 18. | Edge |
| 19a. | Large tool with rectangular shaped head |
| 19b | Medium tool with rectangular shaped head |
| 19c. | Small tool with rectangular shaped head |
| 20. | Pyramidal shaped head portion |
| 21. | Pyramidal shaped top portion |
| 22. | Smooth handle portion |
| 23. | Edge |
| 24. | Flat rectangular shaped underside portion |
| 25. | Flat triangular shaped back portion |
| 26. | Tool with oval shaped head |
| 27. | Oval shaped head portion |
| 28. | Smooth handle portion |
| 29. | Dome shaped top portion |
| 30. | Flat oval shaped underside portion |
| 31. | Front edge |
| 32. | Back edge |

SUMMARY OF THE INVENTION

This invention relates generally to a device comprising a collection of different shaped and sized tools (wedge, elliptical, rectangular and oval shaped) for sculpting sand into free form shapes for use by children and adults. The tools are brightly colored for aesthetic appearances, as well as to make the tools visible if they are buried in the sand or swept by the tide away from the user. The tools are also preferably made of waterproof plastic, in order to be easily cleaned, as well as to float in order not to sink if tides sweep into the work area. They are not breakable or fracturable, can withstand normal wear and tear; therefore are safe for children and use at the beach. The tools are contained in a brightly colored waterproof net carrying bag, for easy viewing, as well as organization and convenience of the user. A water resistant, pocket sized, illustrated instruction booklet at a child's elementary reading level, is included with the device.

Prior art devices disclose tools and kits for making sand, snow and clay sculptures, as well as carving pumpkins. These devices are differentiated from the present invention, in that the prior art uses molds, serrations, and sheets to create shapes. The present invention has varied shaped and sized tools, which aid the user in creating free form shapes. The user's imagination creates the shapes, therefore the designs the user can create are unlimited. Children can enjoy using the tools to make simple sand sculptures. Adults can also use the tools to create finely detailed crafted sculptures for recreational enjoyment, contests or professional use.

The preferred embodiment of the invention comprises a collection of different sized and shaped tools, with each individual tool generally comprising a head portion and handle portion. The collection of tools range from larger sized tools with grooved handles for heavier shoveling and scraping, to finer shaped tools with smooth handles for detailing work.

DESCRIPTION OF THE PREFERRED EMBODIMENT OF THE INVENTION

Referring to the drawings by numerals of reference, this invention comprises tools comprising different shaped and sized tools for sculpting sand into free form shapes.

Figure 2:
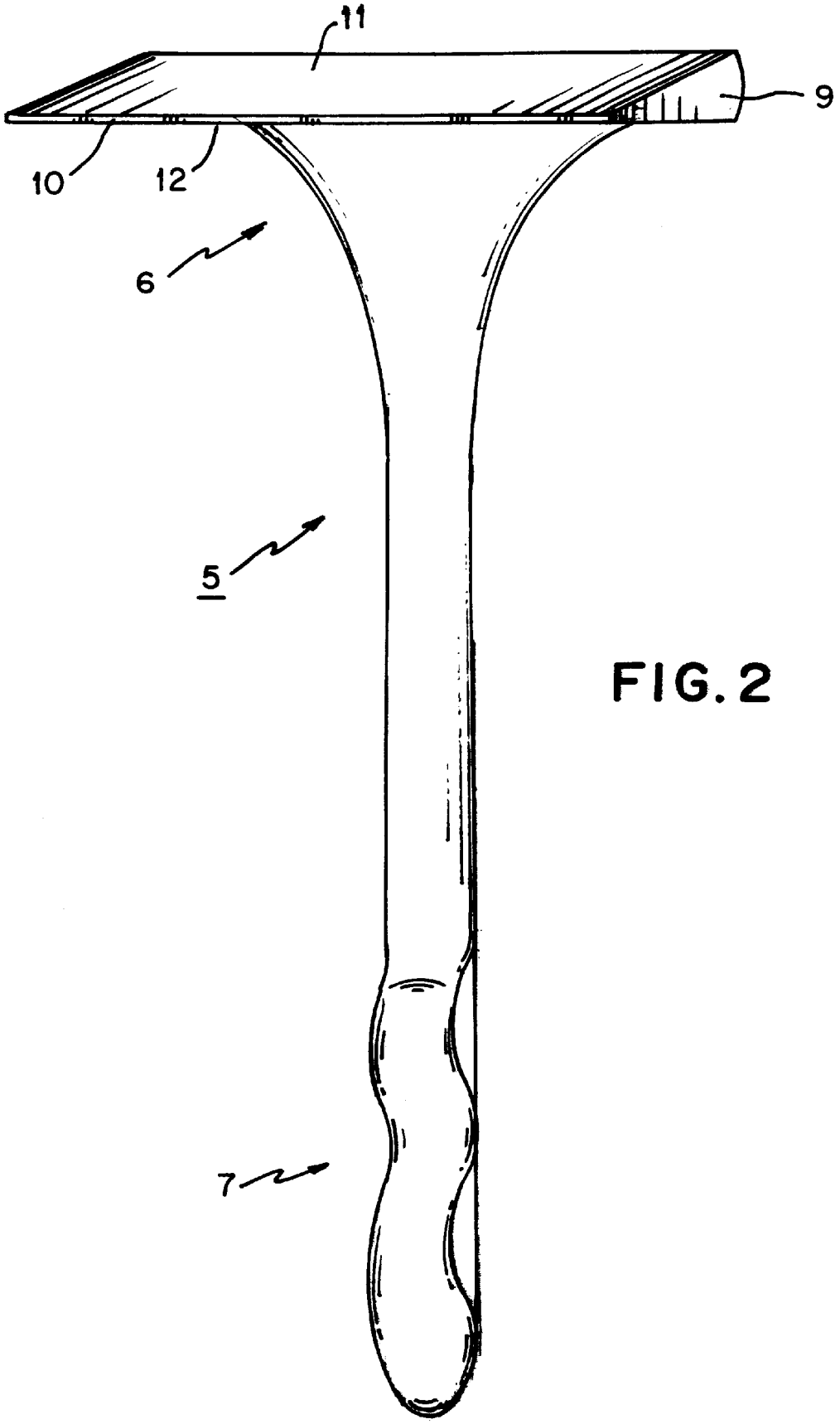
FIG. 2 is a perspective frontal view of the tool with wedged shaped head, showing its flat rectangular shaped top portion for smoothing and packing sand, its flat rectangular shaped underside portion for scraping sand, edge for detailing, a pair of flat triangular shaped side portions for smoothing, and its grooved handle portion.
Figure 3:
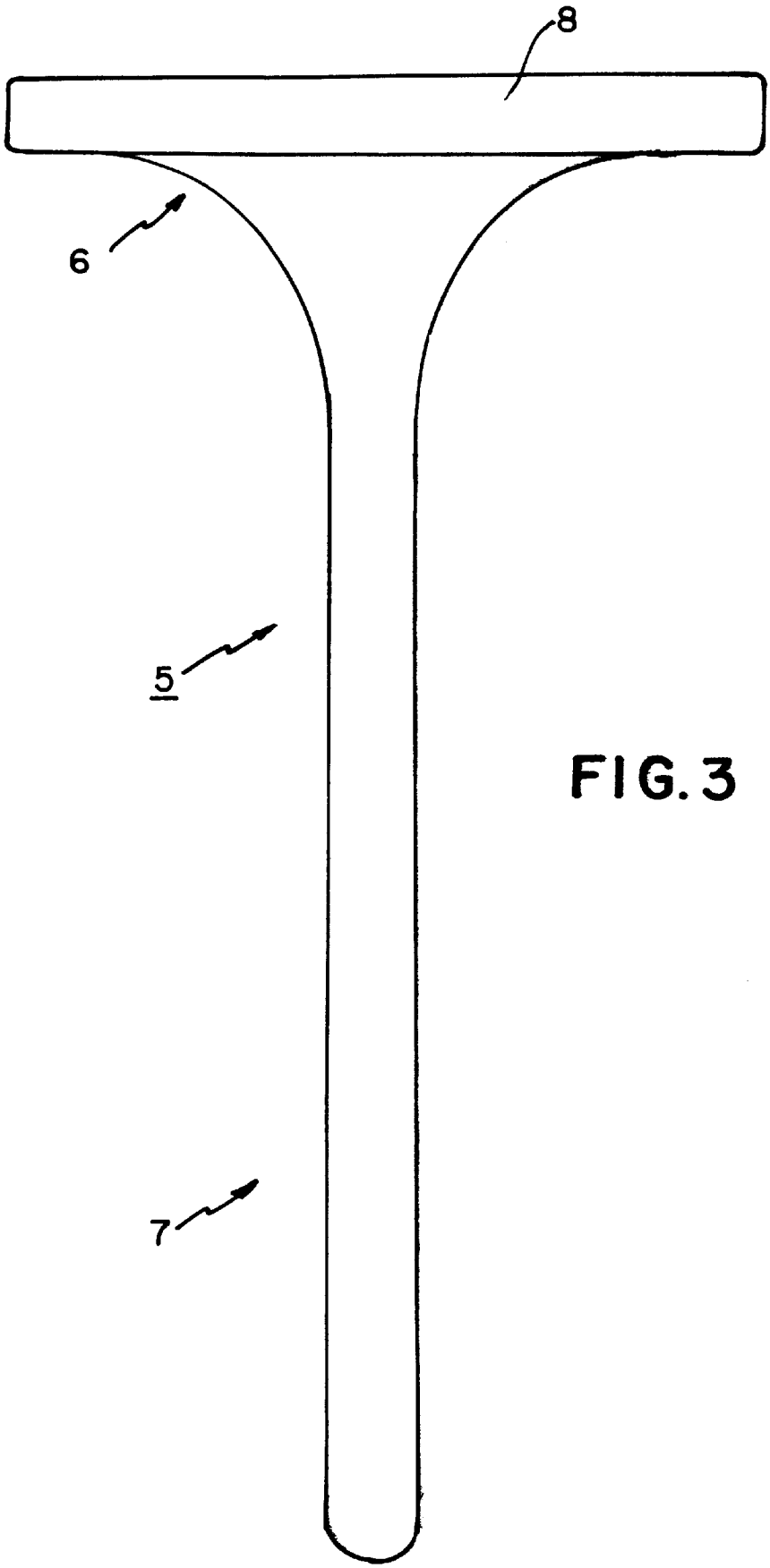
FIG. 3 is a perspective back view of the tool with wedged shaped head, showing its flat rectangular shaped back portion for smoothing.

FIG. 1 illustrates a user 1 (a child), with the device 2 placed on the sand, with the tools 3, 13, 19*a*, 19*b*, 19*c* and 26, taken out of the net carrying bag 3, building a sculpture 4 out of sand, shaped like a castle. The user 1 has the tool with wedge shaped head 5 in its hand, and is holding it by its grooved handle portion 7. Shown in detail in FIG. 2, its flat rectangular shaped underside portion 12 is used to scrap out larger portions of sand. After sufficient scraping the user 1 can smooth and pack down the sand's surface with flat rectangular shaped top portion 11, and create details with the tool's edge 10, and pair of flat triangular shaped side portions 9, and, as shown in FIG. 3, its flat rectangular shaped back portion 8 can also smooth the sand. The remaining tools, tool with an elliptical shaped head 13 (shown in detail in FIGS. 4, 5 & 5*a*), large, medium and small tools with rectangular shaped heads 19*a*, 19*b* & 19*c* (respectively), are shown in FIG. 1 and in detail in FIGS. 6*a*, 6*b* & 6*c*, and tool with an oval shaped head 26, are shown in FIG. 1 and in detail in FIGS. 7*a*, 7*b* & 7*c*, lying on the sand in FIG. 1, can be used together to create different sculpture designs.

Figure 4:
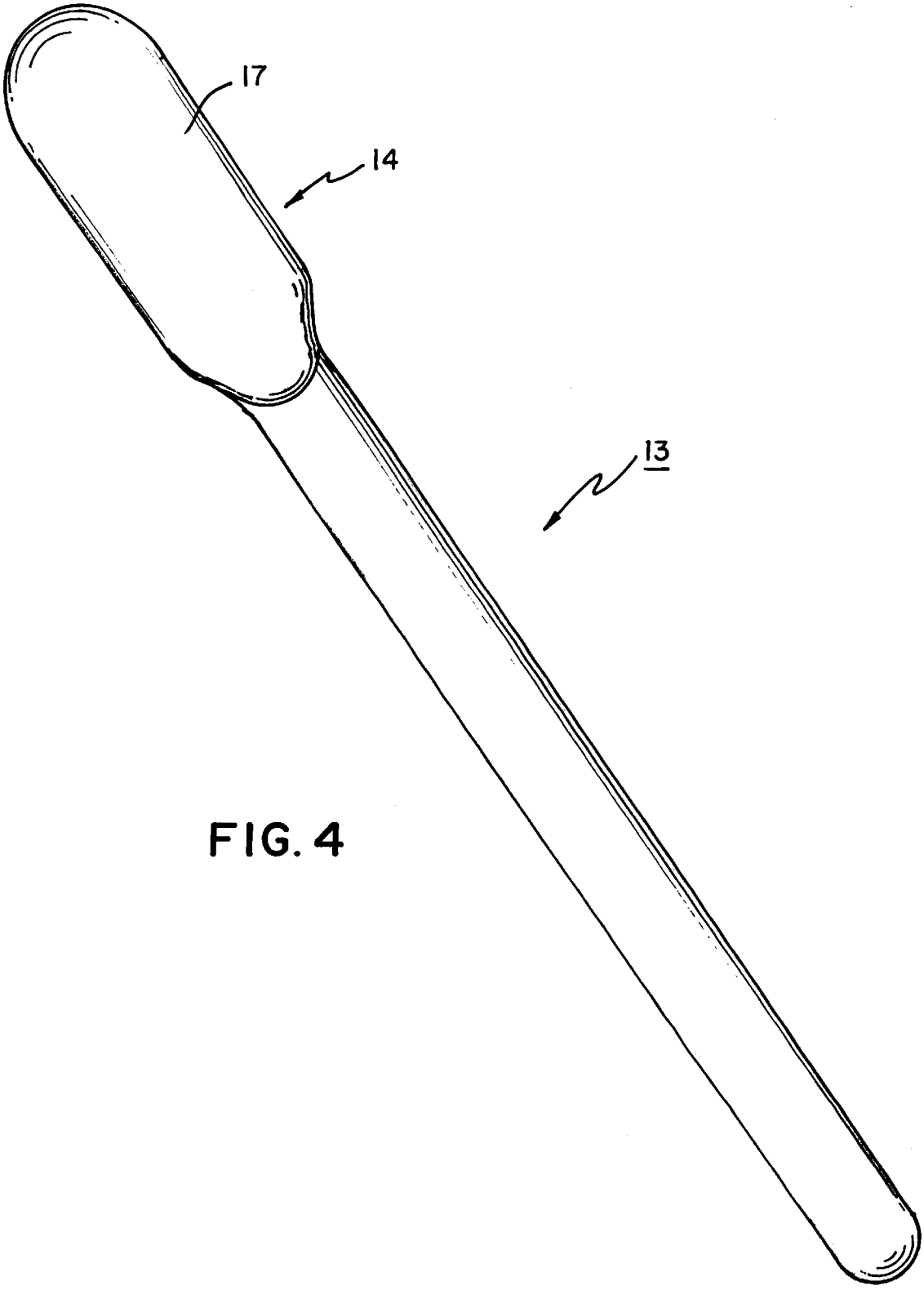
FIG. 4 is a perspective back view of the tool with elliptical shaped head, showing its convex shaped back portion for smoothing.
Figures 5, 5A:
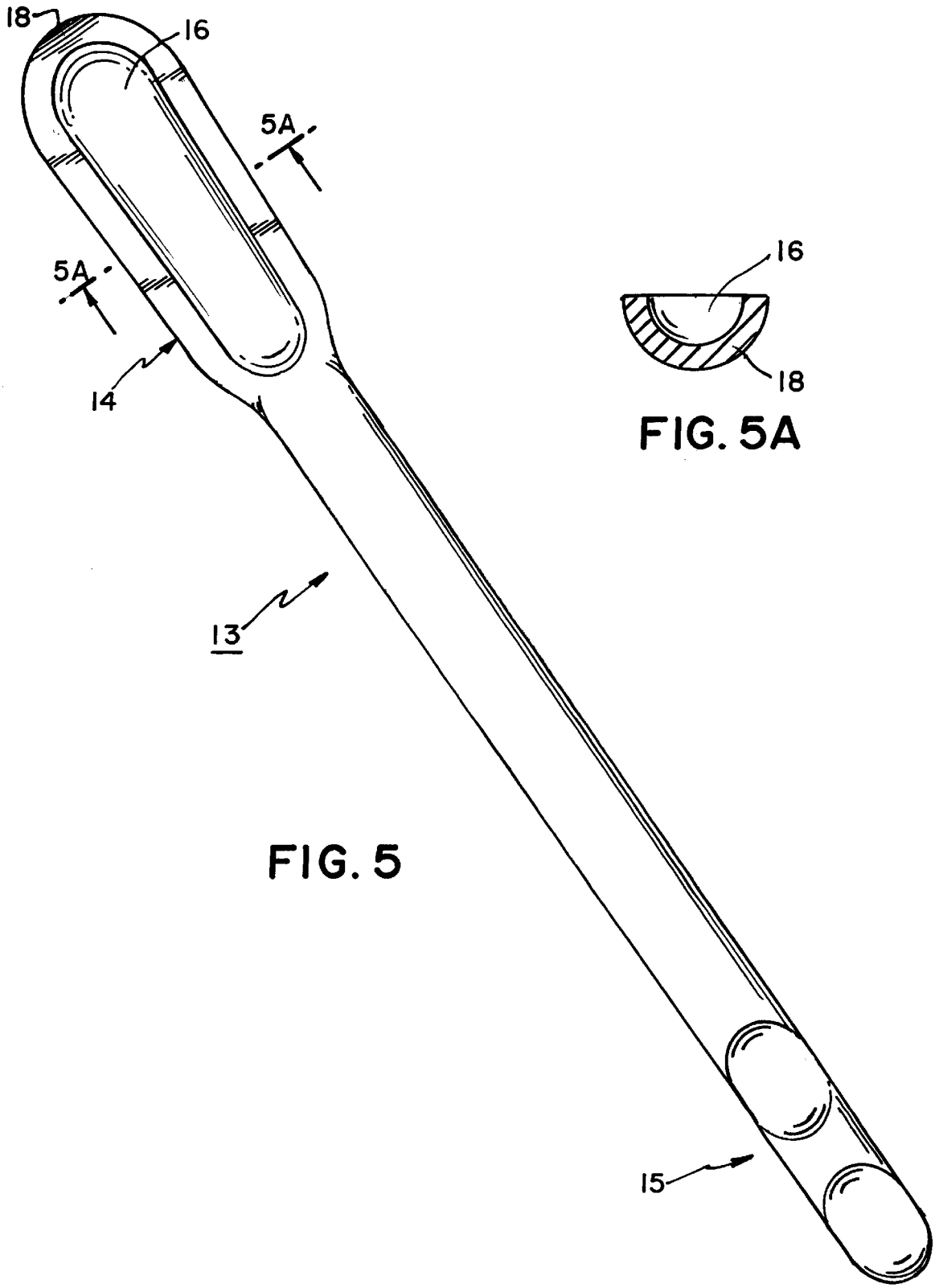
FIG. 5 is a perspective front view of the tool with elliptical shaped head, showing its concave shaped front portion for scraping, edge for detailing, and its grooved handle portion; and in FIG. 5*a*, showing in detail a cross-sectional view of its concave shaped front portion.

The tool with the elliptical shaped head 13 is shown in detail in FIGS. 4, 5 & 5*a*. As shown in FIG. 5, its concave shaped front portion 16 of its elliptical shaped head portion 14, is for scraping, and facilitating the flow of sand away from the user 1 as the sand is removed by scooping. Its edge 18 is for detailing, and its grooved handle portion 15 is designed for a better grip while the user 1, is scraping larger portions of sand. FIG. 5*a* shows a cross-sectional view of the concave shaped front portion 16. As shown in FIG. 4, its convex shaped back portion 17 is for smoothing larger areas of sand.

The large, medium and small tools with the rectangular shaped head 19*a*, 19*b* & 19*c*, (respectively), are shown in FIG. 1, and shown in detail in FIGS. 6*a*, 6*b* and 6*c*. They all have a pyramidal shaped top portion 21 for smoothing, flat rectangular shaped underside portion 24 for scraping, edge 23 for detailing, flat triangular shaped back portion 25 for smoothing, and a smooth handle portion 22, for finer user control and dexterity. FIG. 6*c* is a cross-sectional view of the flat triangular shaped back portion 25 for smoothing.

Figure 7C:
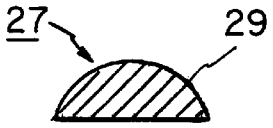
FIG. 7*c* is a cross-sectional view showing the half-crescent shape of the dome shaped top portion.
Figure 7A:
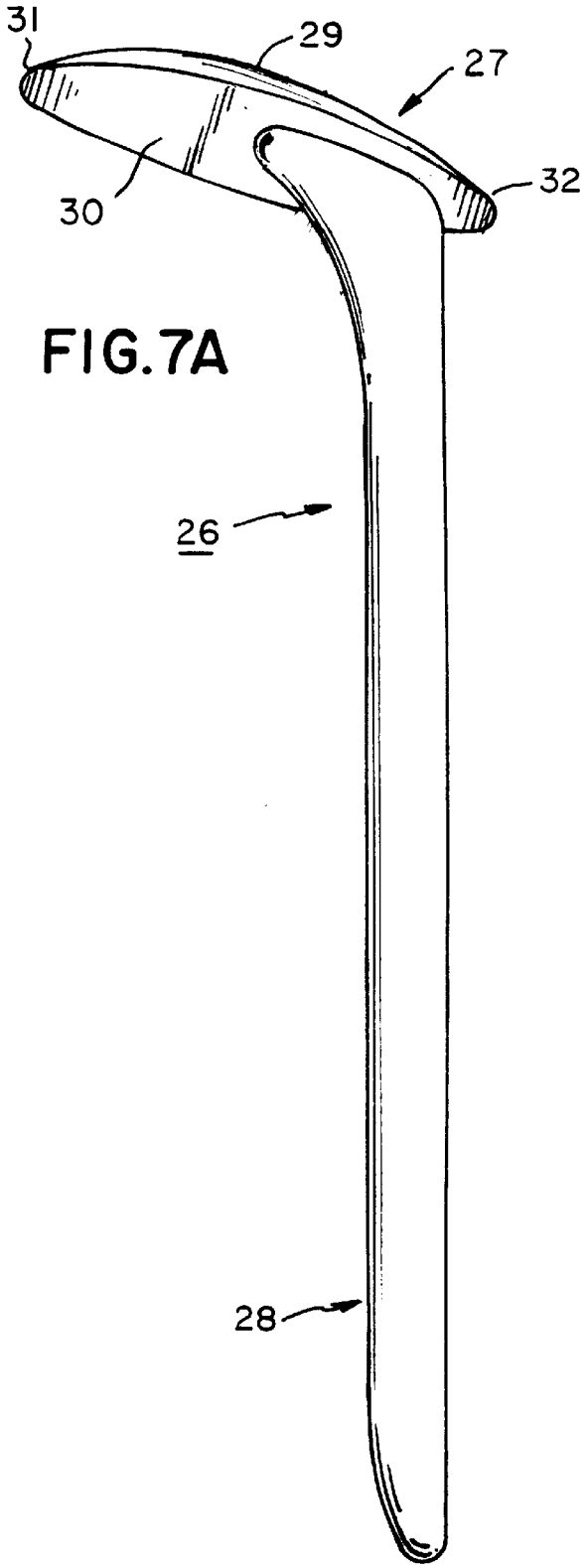
FIG. 7*a* is a perspective underside side view of the tool with oval shaped head, showing its dome shaped top portion for smoothing, its flat oval shaped underside portion for scraping, edge for detailing, and smooth handle portion.
Figure 7B:
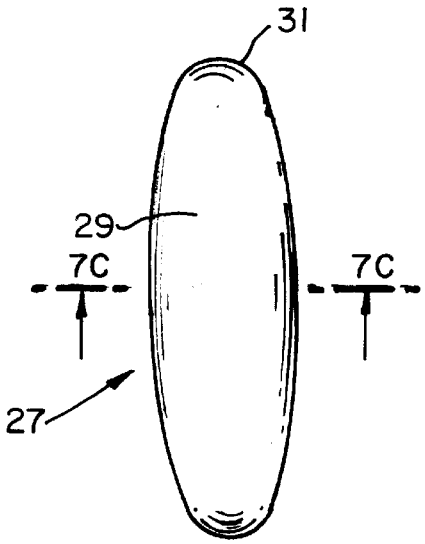
FIG. 7*b* is a perspective top view of the tool with oval shaped head, showing in detail, its dome shaped top portion for smoothing.

As shown in FIGS. 7*a* & 7*b*, the tool with the oval shaped head 26 has a smooth handle portion 28 for dexterity and control, a flat oval shaped underside portion 30 for scraping, a dome shaped top portion 29, and front edge portion 31 and back edge portion 32 for detailing. FIG. 7*c* is a half-crescent shaped cross-sectional view of the dome shaped top portion 29, of the oval shaped head portion 27.

The larger tools with the grooved handles, which comprise the tool with wedge shaped head 5, and the tool with elliptical shaped head 13, are used for heavier duty digging, scraping and smoothing. The tools with the smooth handles, which comprise the large, medium and small tools with rectangular shaped heads 19*a*, 19*b* & 19*c*, (respectively), and the tool with oval shaped head 26, are shaped for better user dexterity, lighter duty scraping and digging, fine detailing and sculpting.

I claim:

1. Device, to be used by both children and adults, for creating sand sculptures, comprising:

a plurality of tools of different sizes and shapes, comprised of brightly colored plastic material, which is strong, durable, safe, waterproof and floats, and enhances viewing if swept by the tide or buried in the sand; wherein said plurality of tools are housed in a container, consisting of a netted bag, and each individual tool included in said plurality of tools further comprises a head portion and a handle portion; and said plurality of tools further comprises a tool with wedge shaped head portion, a tool with elliptical shaped head portion, a tool with rectangular shaped head portion, and a tool with oval shaped head portion, and said head portion of said tool with wedge shaped head portion further comprises a flat rectangular shaped top portion, a flat rectangular shaped underside portion, a pair of flat triangular shaped side portions, and an edge; and said handle portion of said tool with wedge shaped head portion further comprises a plurality of grooves; wherein said flat rectangular shaped top portion is for smoothing and tapping down said sand, said flat rectangular shaped underside portion is for scraping and scooping said sand, said pair of flat triangular shaped side portions are for smoothing said sand, said edge is for detailing said sand, and said plurality of grooves is for better gripping said handle portion while digging said sand, and said head portion of said tool with elliptical shaped head portion further comprises a concave shaped front portion, a convex shaped back portion, and an edge; and said handle portion of said tool with elliptical shaped head portion further comprises a plurality of grooves; wherein said concave shaped front portion is for scraping and scooping said sand, said convex shaped back portion is for smoothing said sand, said edge is for detailing said sand, and said plurality of grooves is for better gripping said handle portion while digging said sand, and said head portion of said tool with rectangular shaped head portion further comprises a pyramidal shaped top portion, a flat rectangular shaped underside portion, a flat triangular shaped back portion, and an edge; and said handle portion of said tool with rectangular shaped head portion further comprises a smooth handle portion with a smooth surface; wherein said pyramidal shaped top portion is for smoothing said sand, said flat rectangular shaped underside portion is for scraping and scooping said sand, said flat triangular shaped back portion is for smoothing said sand, said edge is for detailing said sand, and said smooth handle portion with said smooth surface is for better dexterity and control, and said head portion of said tool with oval shaped head portion further comprises a dome shaped top portion, a flat oval shaped underside portion, and a front and back edge; and said handle portion of said tool with oval shaped head portion further comprises a smooth handle portion with a smooth surface; wherein said dome shaped top portion is for smoothing said sand, said flat oval shaped underside portion is for scraping and scooping said sand, said front and back edge are for detailing said sand, and said smooth handle portion with said smooth surface is for better dexterity and control, whereby, said each individual tool can be used separately or together to create said sand sculptures.

2. Device, to be used by both children and adults, for creating sand sculptures, comprising:

a plurality of tools of different shapes and sizes, comprised of brightly colored plastic material, which is strong, durable, safe, waterproof, and floats, and enhances viewing if swept by the tide or buried in the sand; wherein said plurality of tools are housed in a container, consisting of a netted bag comprised of plastic, which is strong durable, safe, waterproof, and floats, and each individual tool included in said plurality of tools further comprises a head portion and a handle portion; and said plurality of tools further comprises a tool with wedge shaped head portion, a tool with elliptical shaped head portion, a tool with rectangular shaped head portion, and a tool with oval shaped head portion, and said head portion of said tool with wedge shaped head portion further comprises a flat rectangular shaped top portion, a flat rectangular shaped underside portion, a pair of flat triangular shaped side portions, and an edge; and said handle portion of said tool with wedge shaped head portion further comprises a plurality of grooves; wherein said flat rectangular shaped top portion is for smoothing and tapping down said sand, said flat rectangular shaped underside portion is for scraping and scooping said sand, said pair of flat triangular shaped side portions are for smoothing said sand, said edge is for detailing said sand, and said plurality of grooves is for better gripping said handle portion while digging said sand, and said head portion of said tool with elliptical shaped head portion further comprises a concave shaped front portion, a convex shaped back portion, and an edge; and said handle portion of said tool with elliptical shaped head portion further comprises a plurality of grooves; wherein said concave shaped front portion is for scraping and scooping said sand, said convex shaped back portion is for smoothing said sand, said edge is for detailing said sand, and said plurality of grooves is for better gripping said handle portion while digging said sand, and said head portion of said tool with rectangular shaped head portion further comprises a pyramidal shaped top portion, a flat rectangular shaped underside portion, a flat triangular shaped back portion, and an edge; and said handle portion of said tool with rectangular shaped head portion further comprises a smooth handle portion with a smooth surface; wherein said pyramidal shaped top portion is for smoothing said sand, said flat rectangular shaped underside portion is for scraping and scooping said sand, said flat triangular shaped back portion is for smoothing said sand, said edge is for detailing said sand, and said smooth handle portion with said smooth surface is for better dexterity and control, and said head portion of said tool with an oval shaped head portion further comprises a dome shaped top portion, a flat oval shaped underside portion, and a front and back edge; and said handle portion of said tool with oval shaped head portion further comprises a smooth handle portion with a smooth surface; wherein said dome shaped top portion is for smoothing said sand, said flat oval shaped underside portion is for scraping and scooping said sand, said front and back edge are for detailing said sand, and said smooth handle portion with said smooth surface is for better dexterity and control, whereby, said each individual tool can be used separately or together to create said sand sculptures.

3. Device, to be used by both children and adults, for creating sand sculptures, comprising:

a plurality of tools, of different shapes and sizes, comprised of brightly colored plastic material, which is strong, durable, safe, waterproof and floats, and enhances viewing if swept by the tide or buried in the sand; wherein said plurality of tools are housed in a container, consisting of a brightly colored netted bag, which enhances viewing if swept by the tide or buried in the sand, and each individual tool included in said plurality of tools further comprises a head portion and a handle portion, and said plurality of tools further comprises a tool with wedge shaped head portion, a tool with elliptical shaped head portion, a tool with rectangular shaped head portion, and a tool with oval shaped head portion, and said head portion of said tool with wedge shaped head portion further comprises a flat rectangular shaped top portion, a flat rectangular shaped underside portion, a pair of flat triangular shaped side portions, and an edge; and said handle portion of said tool with wedge shaped head portion further comprises a plurality of grooves; wherein said flat rectangular shaped top portion is for smoothing and tapping down said sand, said flat rectangular shaped underside portion is for scraping and scooping said sand, said pair of flat triangular shaped side portions are for smoothing said sand, said edge is for detailing said sand, and said plurality of grooves is for better gripping said handle portion while digging said sand, and said head portion of said tool with elliptical shaped head portion further comprises a concave shaped front portions a convex shaped back portion, and an edge; and said handle portion of said tool with elliptical shaped head portion further comprises a plurality of grooves; wherein said concave shaped front portion is for scraping and swooping said sand, said convex shaped back portion is for smoothing said sand, said edge is for detailing said sand, and said plurality of grooves is for better gripping said handle portion while digging said sand, and said head portion of said tool with rectangular shaped head portion further comprises a pyramidal shaped top portion, a flat rectangular shaped underside portion, a flat triangular shaped back portion, and an edge; and said handle portion of said tool with rectangular shaped head portion further comprises a smooth handle portion with a smooth surface; wherein said pyramidal shaped top portion is for smoothing said sand, said flat rectangular shaped underside portion is for scraping and scooping said sand, said flat triangular shaped back portion is for smoothing said sand, said edge is for detailing said sand, and said smooth handle portion with said smooth surface is for better dexterity and control, and said head portion of said tool with oval shaped head portion further comprises a dome shaped top portion, a flat oval shaped underside portion, and a front and back edge; and said handle portion of said tool with oval shaped head portion further comprises a smooth handle portion with a smooth surface; wherein said dome shaped top portion is for smoothing said sand, said flat oval shaped underside portion is for scraping and scooping said sand, said front and back edge are for detailing said sand, and said smooth handle portion with said smooth surface is for better dexterity and control, whereby, said each individual tool can be used separately or together to create said sand sculptures.

* * * * *